US007048581B1

(12) United States Patent
Wong

(10) Patent No.: US 7,048,581 B1
(45) Date of Patent: May 23, 2006

(54) TPA CONNECTOR FOR ROTATABLE TERMINALS

(75) Inventor: Richard P. Wong, Troy, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 10/975,753

(22) Filed: Oct. 28, 2004

(51) Int. Cl.
*H01R 13/40* (2006.01)

(52) U.S. Cl. ..... 439/595; 439/752

(58) Field of Classification Search ..... 439/752, 439/599, 744, 594, 296
See application file for complete search history.

(56) References Cited

U.S. PATENT DOCUMENTS 4,787,864 A * 11/1988 Hunt et al. ..... 439/595
4,979,913 A 12/1990 Aiello et al.
5,100,345 A 3/1992 Endo et al.
5,122,080 A * 6/1992 Hatagishi et al. ..... 439/595
5,752,859 A 5/1998 Abe et al.
6,402,573 B1 6/2002 Yeomans
6,491,542 B1 12/2002 Zerebilov
6,773,304 B1 * 8/2004 Conway et al. ..... 439/595

* cited by examiner

*Primary Examiner*—Hae Moon Hyeon
(74) *Attorney, Agent, or Firm*—Young & Basile, P.C.

(57) ABSTRACT

A plastic connector having a terminal position assurance (TPA) component receives a radio frequency terminal having a cylindrical casting as a portion thereof in snap lock relationship within the interior of the connector body. The TPA may be resiliently snapped between the outermost "preset" and innermost "set" positions, the former permitting operation of the snap lock lance which comes into play when the terminal is inserted into the connector body. In the latter position, the TPA blocks movement of the lance and provides a semi-circular stabilizing cradle in conforming contact with the terminal body to protect it against rocking motion while at the same time allowing rotation of the terminal about its own axis or symmetry. The TPA may also be moved from the "preset" position to a "service" position which allows access to the connector lance.

7 Claims, 5 Drawing Sheets

TPA CONNECTOR FOR ROTATABLE TERMINALS

FIELD OF THE INVENTION

This invention relates to connectors for electrical terminals, more particularly to a two-part connector having a terminal position assurance (TPA) feature and which accommodates terminals which must be rotatable within the connector structure.

BACKGROUND OF THE INVENTION

It is common to use connectors of plastic or other dielectric materials to hold or carry terminals used to make electrical connections in various environments, including automobile wiring. The connectors add structural integrity to the terminal connection, furnish additional terminal connection holding power and can provide mounting convenience. A typical arrangement may include a complemental set of male and female plastic connectors with a detent, position guide and/or snap lock feature which permits the connectors to be coupled to one another and to remain coupled during normal use. Each connector is adapted to receive an electrical terminal, through one opening into an internal cavity. The cavity is usually designed with tolerances which permit a certain amount of lateral play between the terminal and the connector.

One known connector includes a sidewall which is slotted or perforated to provide a laterally resilient tab or "lance" having a half-arrowhead type of cam surface on the interior thereof. The barb on the half-arrowhead ramps up away from the terminal-receiving opening such that when the terminal is inserted through the opening, the side of the terminal engages the cam surface of the lance and pushes the lance outwardly until the body of the terminal passes the cam surface on the lance, at which time the lance snaps back in behind the terminal body to prevent the terminal body from being withdrawn. If the lance is externally accessible, it can be flexed outwardly with a small blade to allow removal of the terminal. This is common in well known arrangements; see for example U.S. Pat. No. 6,491,542, "Combined Connection and Terminal Position Assurance Structure for Vehicle Wiring Connectors," assigned to Yazaki North America.

It is also known to provide terminal position assurance (TPA) features on plastic connectors. In general, TPA's involve an additional component which is snapped onto or otherwise secured to the connector body in such a way that they cannot be moved to the locked or set position unless the terminal is fully inserted into the connector body; i.e. a partially-inserted connector urges the lance outwardly enough to interfere with moving the TPA to the locked or set position. The aforementioned '542 patent shows a TPA.

SUMMARY OF THE INVENTION

The present invention resides in a connector for an electrical terminal wherein the connector has, in addition to a TPA feature as described above, a stabilizing feature in which the TPA engages the fully-inserted terminal body so as to prevent it from rocking within the connector and yet which permits relative rotation between the terminal and the connector about the longitudinal axis of the terminal. This is particularly useful in the case of radio frequency (RF) terminals having cylindrical bodies and which are subject to automotive assembly and performance regulations requiring rotatability of the RF terminal or terminals after they have been mounted in connectors and joined to make an electrical connection. Even if not required, allowing rotation protects the integrity of the terminal connection with a coaxial cable, and prevents damage to the cable.

Still another feature of the invention is a connector having a TPA feature wherein the TPA component has a "preset" position on the connector in which it shields the lance, and a "service" position in which the lance can be accessed by a screwdriver or other bladed tool to permit the terminal to be disconnected and removed from the connector body.

The various features and advantages of the invention will be best understood from a reading of the following specification which describes an illustrative embodiment thereof in detail.

DETAILED DESCRIPTION OF THE ILLUSTRATIVE EMBODIMENT

Figure 1:
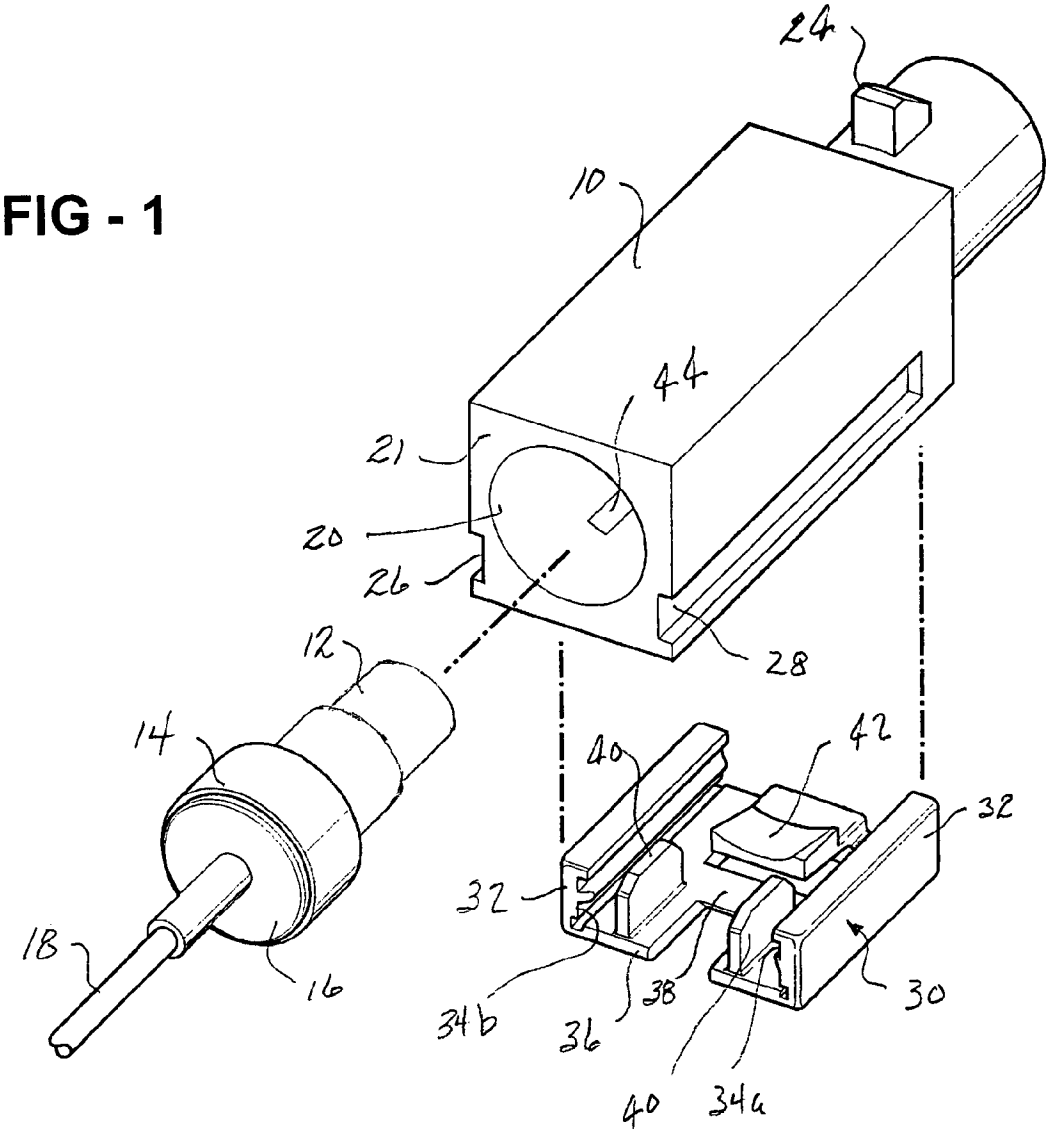
FIG. 1 is an exploded perspective view of one side of a connector/terminal combination showing generally the association between a male RF terminal, a connector body and a TPA feature.

Referring to FIG. 1, there is shown a male connector 10 adapted to receive therein a male RF terminal 12 having a cylindrical cast metal body 14 with a rear flange 16, the body 14 being secured to a copper wire 18. The terminal is more fully described in U.S. Pat. No. 6,491,542, the disclosure of which is incorporated herein by reference.

The connector 10 has a hollow interior accessed by an opening 20 in to the rear surface 21 and a male plug portion 22 adapted to mate with a complemental female connector (not shown) and snap locked thereto by means of a tab 24. Opposite parallel guide slots 26 and 28 are formed in the sidewalls of the connector 10 to receive a TPA component 30. The TPA component has a base 36 with integral side members 32. Parallel guide slots 34*a* and 34*b* are formed in the interior surfaces of the side members 32 to cooperate with the slots 26 and 28 in the connector 10 such that the TPA component 30 can be snapped onto the connector in two stable positions; i.e., an outward position in which slots 34*a* are operative, and an innermost position in which slots 34*b* are operative. The parallel guide slots 34*a* and 34*b* on the side members of the TPA component and the slots 26 and 28 in the connector 10 represent one type of structure that enables movement between the positions. However, other structure can be used. For example, one of the slots in each side member can be put on the connector rather than the TPA component to provide the stepped arrangement. A base 36 includes a crossbar 38 and upstanding spaced parallel ribs 40 which fit into slots 44 in the connector 10. The slots 44 are longer than the ribs 40 to allow the TPA component to move along the connecter while guiding and stabilizing such movement. Finally, a resilient cantilevered stabilizer 42 having a shallow cylindrical contact surface is integrally molded into the TPA between the side members 32.

In the illustrated embodiment the connector 10 is shown in combination with a male terminal 12, but a female terminal having a similar exterior configuration can also be employed; i.e. it is to be understood that only half of a typical circuit connection is illustrated in FIG. 1 and the components on opposite sides thereof can be mixed and matched as desired. The connector 10 is formed of a non-conductive polymeric material, such as, but not limited to, Nylon and polyethylene. The TPA component 30 is also made of a non-conductive polymer.

The terminal 12 is shown in this case as an RF terminal, having a cylindrical body which, according to FAKRA II specifications, must remain rotatable within the connector 10 after insertion of the terminal 12 into the connector 10 and after joining the connector 10 to a complemental connector in a complete circuit assembly.

Figure 2:
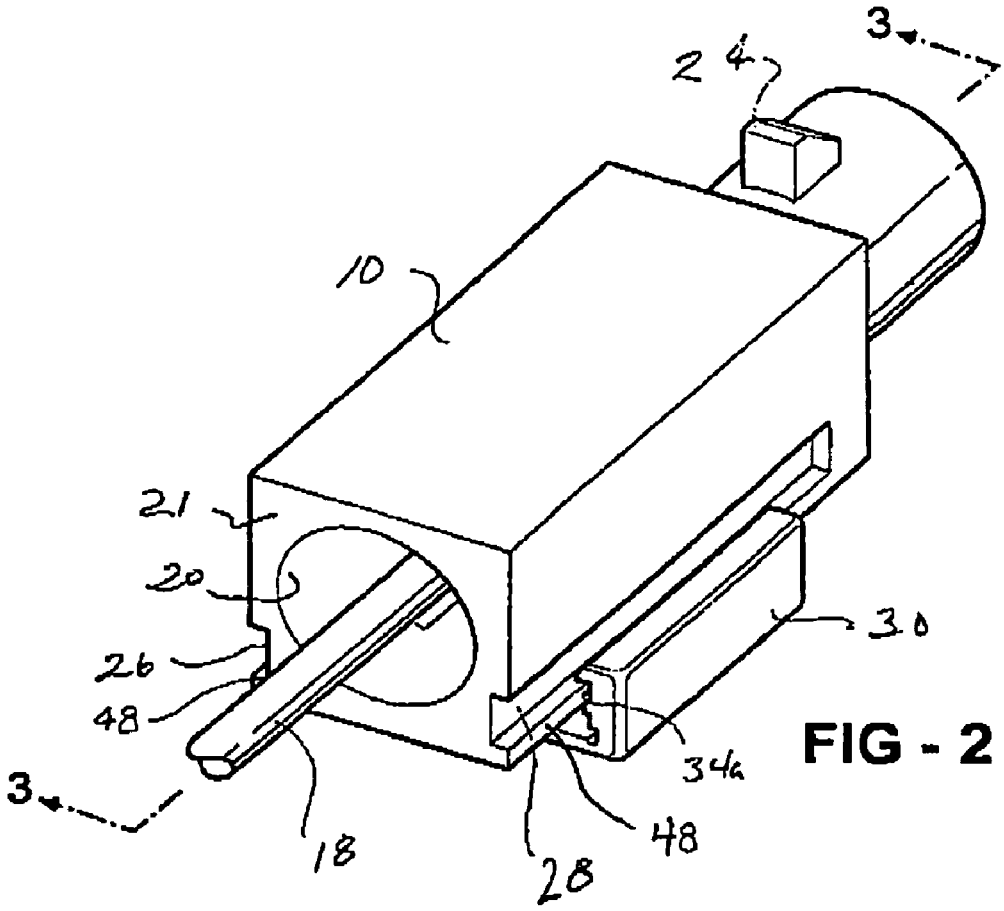
FIG. 2 is a perspective view of the components of FIG. 1 in an assembled and "preset" position.
Figure 3:
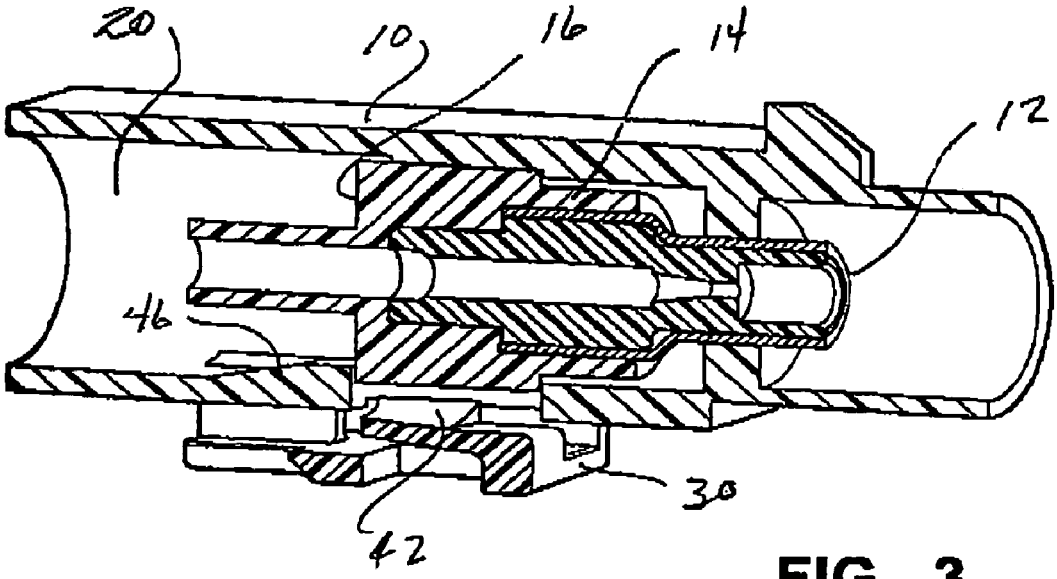
FIG. 3 is a sectional view of the assembly of FIG. 2 in the same position.
Figure 5:
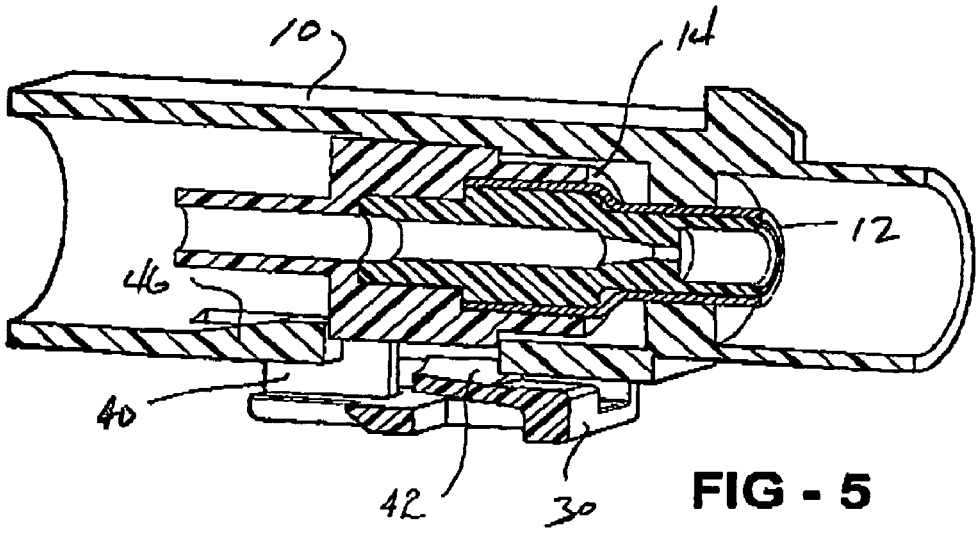
FIG. 5 is a cross-sectional view of the device of FIG. 4 in the same position.

Looking now to FIGS. 2 and 3, the assembly of FIG. 1 is shown after the terminal 12 with its cast metal body 14 has been fully inserted into the interior of the connector through the opening 20 in the rear surface 21. In order to achieve such full insertion, the cast metal body 14 must engage and ride over the interior cam surface of the lance 46 which is formed by slotting through the sidewall of the connector body 10 as shown in FIG. 5. Once the terminal 12 is fully inserted, the resiliently flexible lance 46 springs back in behind the rear flange 16 to prevent removal of the terminal from the interior volume of the connector 10. The TPA 30 must be in the outermost or "preset" position to allow the lance 46 to flex outwardly.

Also shown in FIGS. 2 and 3, the TPA component 30 is assembled to the connector 10 by sliding the rails 48, defined by slots 26 and 28 in the connector body, into the radially outermost slot 34*a* of the TPA component and engaging the stabilizer ribs 40 of the TPA component into the slots 44 in the sidewall of the connector 10. In the "preset" position of FIGS. 2 and 3, the stabilizer portion 42 of the TPA component lies within an opening or window in the side of the connector body, but does not engage the cylindrical outer surface of the cast body 14.

Figure 4:
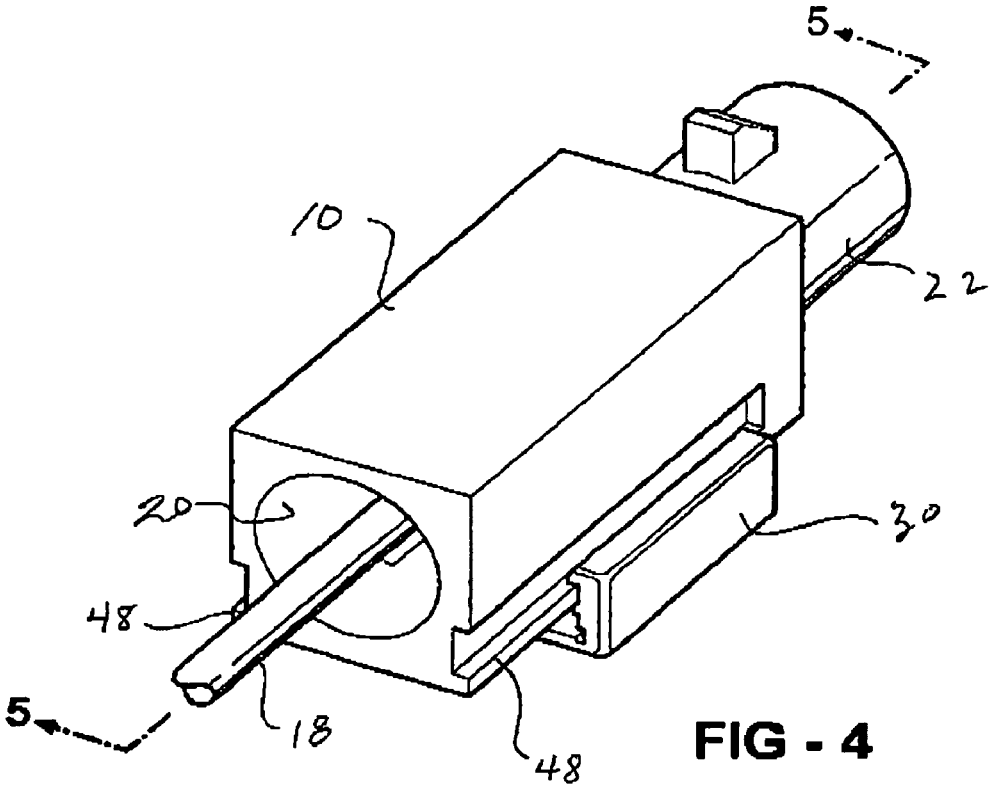
FIG. 4 is a perspective view of the assembly of FIG. 2 in the service position.

Referring now to FIGS. 4 and 5, the assembly is shown with the TPA component 30 in a "service" position, wherein, although it is in its radially outermost position relative to the connector body 10, it is slidingly urged forward or to the right as shown in FIG. 5 to expose enough of the lance 46 and the surrounding window to permit access to the lance by a small bladed tool such that the terminal 12 can be withdrawn from the connector body if desired for inspection, repair or replacement purposes.

Figure 6:
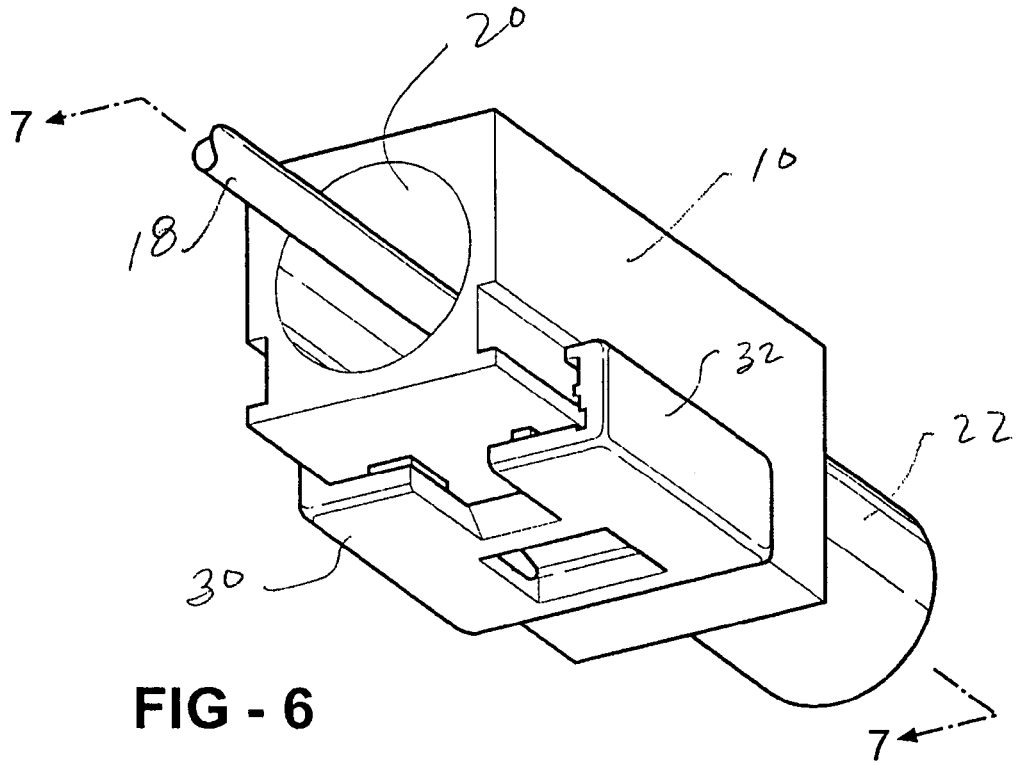
FIG. 6. is a perspective view of the assembly of FIG. 2 in a fully set position.
Figure 7:
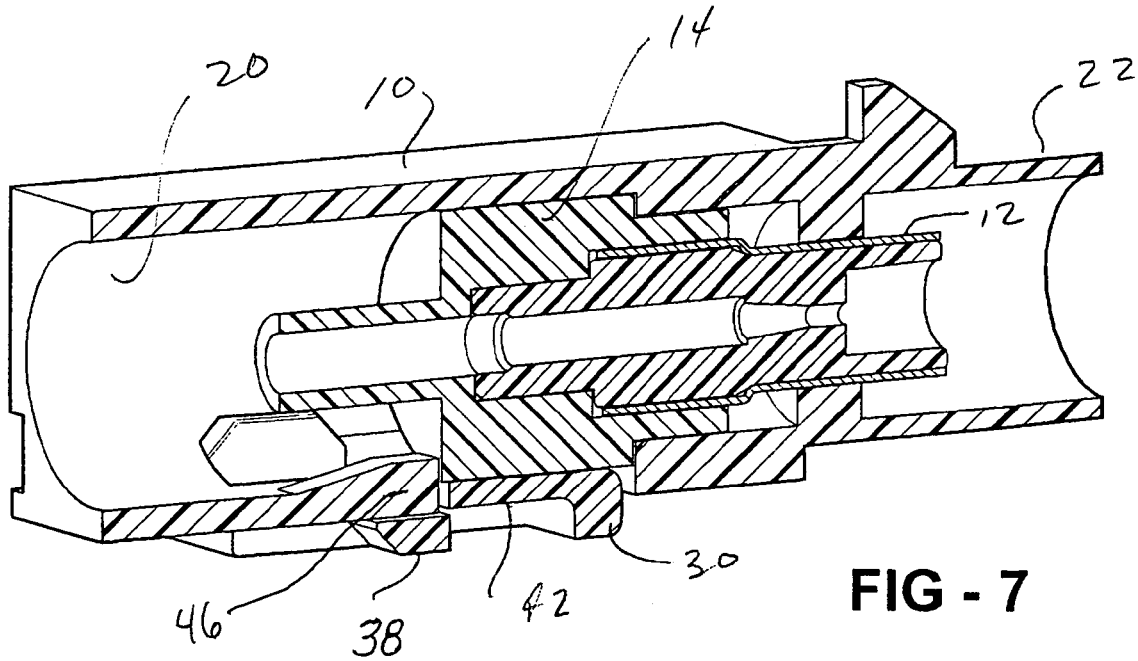
FIG. 7 is a cross-section of the assembly of FIG. 6 in the same position.

Referring to FIGS. 6 and 7, the TPA component 30 is shown assembled to the connector body 10 in the fully set or locked position, which is achieved by sliding the TPA component 30 back to the "preset" position shown in FIG. 3 and then pushing the TPA component 30 inwardly toward the connector body 10 until the slots 34*b* are seated on the connector body below the slots 26 and 28. In this condition the stabilizer 42 of the TPA component 30 conformingly engages and cradles the cylindrical surface of the terminal casting 14 to stabilize the terminal 12 and prevent it from rocking within the connector body 10. However, at the same time, the terminal 12 remains fully rotational within the connector body 10 as required by the FAKRA II standards. The crossbar 38 of the TPA component prevents the lance 46 from flexing outward.

Figure 8:
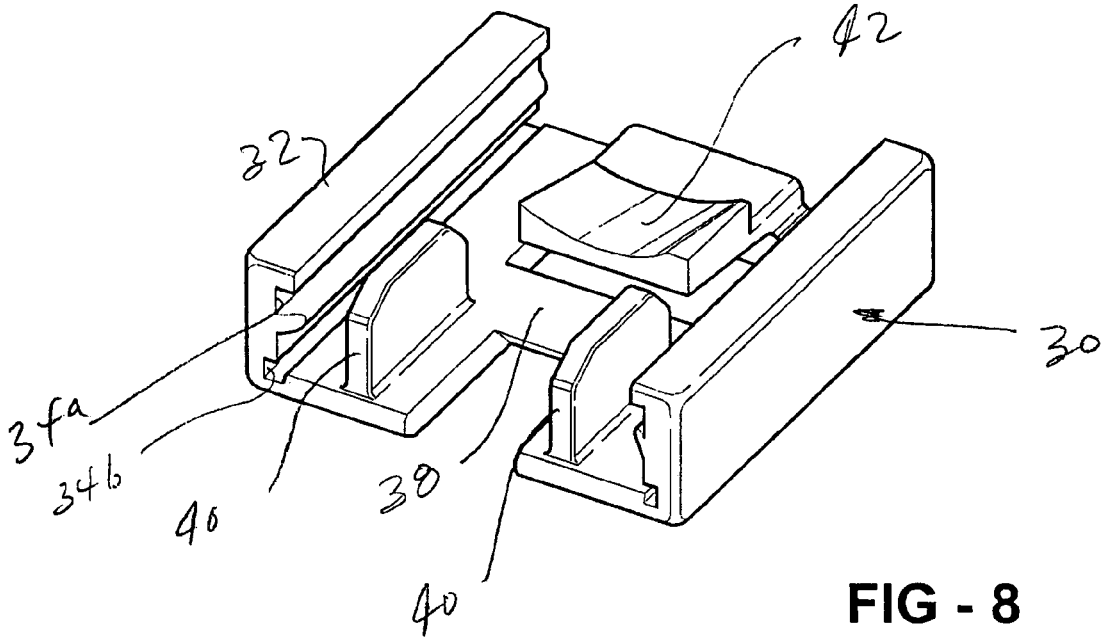
FIG. 8 and FIG. 9 are perspective views from different angles of the TPA component in the assembly of FIGS. 1–7.
Figure 9:
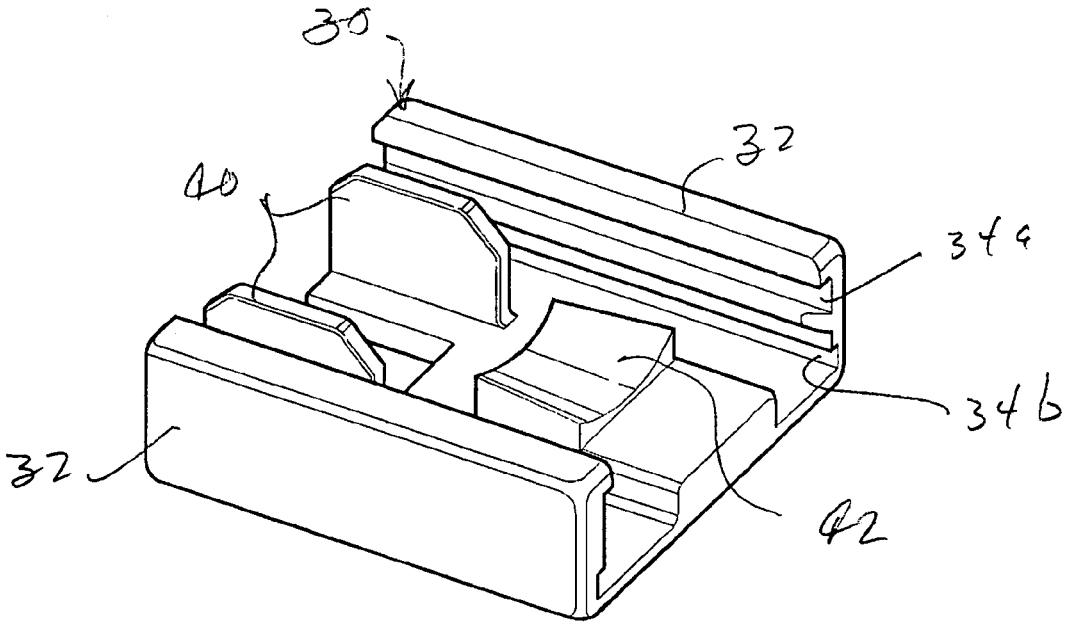

FIGS. 8 and 9 show the TPA component 30 from different angles and illustrate details of the slot pattern 34 on the inside of the side member 32, which permits the TPA component to be moved laterally or radially relative to the connector 10 between the preset and set positions. These figures also clearly illustrate the semi-cylindrical surface of the stabilizer 42 and its cantilevered relationship to the base 36 of the component 30.

It is to be understood that a full connector assembly using the invention shown in FIG. 1 includes a second connector with a second terminal, the two connectors and terminals being complemental to and mateable with the terminal and connector, a combination illustrated in the drawings. It is also to be understood that various changes and modifications to the structure illustrated herein can be made while retaining the essential functional features of the invention as will be apparent to those skilled in the art.

What is claimed is:

1. A connector having a hollow interior adapted to receive an electrical terminal having a cylindrical body, the connector comprising;

an opening formed in the connector to admit the terminal;

a lance resiliently disposed on the connector to flex outwardly where the terminal is inserted into the connector and to lock the terminal within the hollow interior;

parallel slots formed in opposite exterior surfaces of the connector;

a terminal position assurance (TPA) component disposable on the connector in two stable positions the TPA component comprising a base portion with spaced apart parallel side walls disposed in laterally adjustable contacting relationship with the slots in the connector;

said TPA component having a stabilizer portion which, in a first position of the TPA component relative to the connector, is in spaced relationship to the cylindrical body of the terminal and which, in a second position relative to the connector, lies in conforming and contacting engagement with the cylindrical body to stabilize the body against rocking movement while permitting rotation thereof about its own longitudinal axis of symmetry, wherein the stabilizer portion has formed an integral resiliently cantilevered relationship to the TPA component base and exhibits a shallow cylindrical inner surface which comes into contact with the cylindrical terminal body when the TPA component is laced in the second position.

2. The connector as defined in claim 1, wherein the TPA component is mounted on the connector in an outermost preset position and an innermost set position, said TPA component being longitudinally slidable relative to the connector between a first outermost position and a second outermost position wherein the configuration of the TPA component permits access to the lance on the connector.

3. The connector as defined in claim 1 further including a radio frequency terminal mounted within the connector body.

4. A connector having a hollow interior adapted to receive an electrical terminal having a cylindrical body, the connector comprising:

an opening formed in the connector to admit the terminal;

a lance resiliently disposed on the connector to flex outwardly where the terminal is inserted into the connector and to lock the terminal within the hollow interior;

a terminal position assurance (TPA) component mounted on the connection an outermost present position and an innermost set position, said TPA component being longitudinally slidable relative to the connector between a first outermost position and a second outermost position wherein the configuration of the TPA component permits access to the lance on the connector;

said TPA component having a stabilizer portion which, in the outermost positions of the TPA component relative to the connector, is in spaced relationship to the cylindrical body of the terminal and which, in the innermost set position relative to the connector, lies in conforming and contacting engagement with the cylindrical body to stabilize the body against rocking movement while permitting rotation thereof about its own longitudinal axis of symmetry the TPA component further having a crossbar for preventing outward flexing of the lance when the TPA component is in the innermost set position.

5. The connector as defined in claim 4 further comprising slots in the connector and corresponding ribs on the TPA component for fitting into the slots.

6. A connector having a hollow interior adapted to receive an electrical terminal having a cylindrical body, the connector comprising:

an opening formed in the connector to admit the terminal; and a terminal position assurance (TPA) component disposable on the connector in two stable positions, the TPA component having a base and a resilient stabilizer cantilevered from the base, the stabilizer having a shallow cylindrical contact surface, such that in the first stable position of the TPA component relative to the connector, the stabilizer is in spaced relationship to the cylindrical body of the terminal, and in a second stable position of the TPA component relative to the connector, the shallow cylindrical contact surface of the stabilizer lies in conforming and contacting engagement with the cylindrical body of the terminal to stabilize the body against rocking movement while permitting rotation thereof about its own longitudinal axis of symmetry.

7. The connector as defined in claim 6 further comprising a lance resiliently disposed on the connector to flex outwardly where the terminal is inserted into the connector and to lock the terminal within the hollow interior, and wherein the TPA component further comprises a crossbar positioned to prevent outward flexing of the lance when the TPA component is in the second stable position.

* * * * *